US005703006A

United States Patent [19]

Mori et al.

[11] Patent Number: 5,703,006

[45] Date of Patent: Dec. 30, 1997

[54] THERMOSENSITIVE RECORDING MEDIUM

[75] Inventors: Yasutomo Mori; Motoi Orihara; Kunihiko Hada; Shuji Miyamoto, all of Numazu, Japan

[73] Assignee: Ricoh Company, Ltd., Tokyo, Japan

[21] Appl. No.: 584,355

[22] Filed: Jan. 11, 1996

[30] Foreign Application Priority Data

Jan. 12, 1995 [JP] Japan ..... 7-019720

[51] Int. Cl.[6] ..... B41M 5/30

[52] U.S. Cl. ..... 503/207; 503/208; 503/209; 503/216; 503/217; 503/221

[58] Field of Search ..... 427/150–152; 503/209, 216, 217, 221, 226, 207

[56] References Cited

U.S. PATENT DOCUMENTS 5,342,649 8/1994 Sarokin ..... 427/150

FOREIGN PATENT DOCUMENTS 0 616 897 9/1994 European Pat. Off. .

*Primary Examiner*—Bruce H. Hess

*Attorney, Agent, or Firm*—Oblon, Spivak, McClelland, Maier & Neustadt, P.C.

[57] ABSTRACT

A thermosensitive recording medium is disclosed which includes a support, and a thermosensitive color-developing layer formed on the support and containing a leuco dye having a melting point of at least 200° C. and a color developer having a melting point of at least 180°.

7 Claims, No Drawings

THERMOSENSITIVE RECORDING MEDIUM

BACKGROUND OF THE INVENTION

This invention relates to a thermosensitive recording medium having a support and a thermosensitive color-developing layer formed on the support and containing a leuco dye and a color developer capable of reacting with the leuco dye at an elevated temperature to develop a color.

Thermosensitive recording media capable of thermally recording an image through coloring reaction of a colorless or light-color leuco dye with a developer such as a phenol compound are now increasingly utilized in various fields such as recording papers for printers of computers and facsimile machines and POS (point of sales) labels. Thus, the thermosensitive recording media are desired to show storage stability even when exposed to light irradiation and to high temperature conditions.

JP-A-3-292193 discloses the use of butyl bis(4-hydroxyphenyl)acetate as a developer in combination with a specific fluoran compound as a leuco dye for improving heat resistance. JP-A-4-10977 suggests the use of a specific diphenoxyethane as a developer and 3-butylamino-6-methyl-7-anilinofluoran as a leuco dye for preventing fatigue of the background at high temperatures. JP-A-64-1578 proposes the incorporation of a phenothiazine compound into a thermosensitive recording layer containing a leuco dye and a developer for improving the lightfastness thereof. JP-A-3-231892 proposes the use of a combination of a specific salicylic acid derivative as a developer with a specific fluoran derivative as a leuco dye. These known techniques, however, are not fully satisfactory with respect to the resistance to heat and light of the thermosensitive recording media.

SUMMARY OF THE INVENTION

It is, therefore, an object of the present invention to provide a thermosensitive recording medium having excellent lightfastness and heat resistance.

Another object of the present invention is to provide a thermosensitive recording medium free of discoloration and deterioration of recorded images and free of coloration of the background even when exposed to high temperature conditions and to light irradiation.

It is a further object of the present invention to provide a thermosensitive recording medium of the above-mentioned type which can give stable images with a high image density even when the heat applied thereto for recording is minimized.

In accomplishing the foregoing object, there is provided in accordance with the present invention a thermosensitive recording medium which includes a support, and a thermosensitive color-developing layer formed on the support and containing a leuco dye having a melting point of at least 200° C. and a color developer having a melting point of at least 180° C.

Other objects, features and advantages of the present invention will become apparent from the detailed description of the preferred embodiments of the invention to follow.

DETAILED DESCRIPTION OF THE PREFERRED EMBODIMENTS OF THE INVENTION

The thermosensitive recording medium of the present invention has a support on which a thermosensitive color-developing layer containing a leuco dye and a color developer is supported. Any conventionally used support, such as paper, a plastic film or a synthetic paper, may be suitably used for the purpose of the present invention.

It is important that the leuco dye used in the present invention have a melting point of at least 200° C., preferably 200°–250° C. in order to obtain good lightfastness and heat resistance. Illustrative of suitable leuco dyes are as follows:

(A) 3-(N-ethyl-p-toluidino)-6-methyl-7-anilinofluoran of the formula:

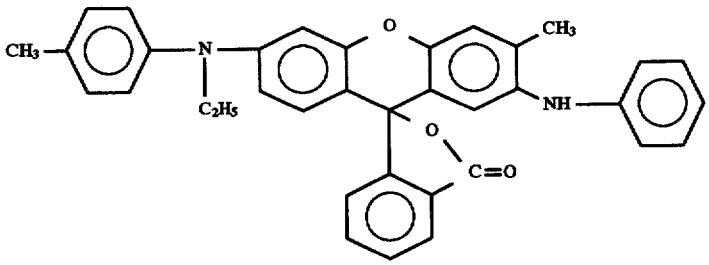

(melting point: 203° C.);

(B) 3-(N-cyclohexyl-N-methylamino-6-methyl-7-anilinofluoran of the formula:

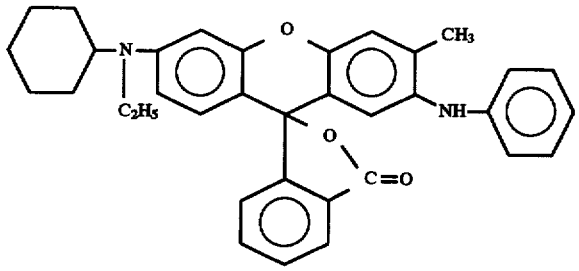

(melting point: 210° C.);

(C) 3-diethylamino-6-methyl-7-o-chloroanilinofluoran of the formula:

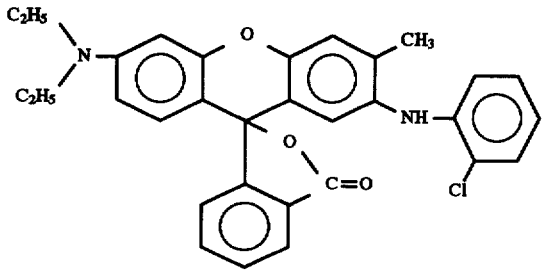

(melting point: 210° C.); and (D) 3-piperidino-6-methyl-7-anilinofluoran of the formula:

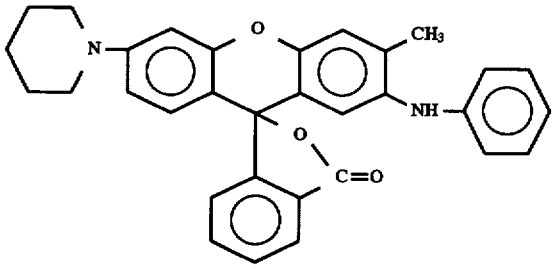

(melting point: 226° C.).

Above all, the use of 3-(N-ethyl-p-toluidino)-6-methyl-7-anilinofluoran is particularly preferred. The leuco dyes may be used singly or in combination of two or more thereof.

If desired, the leuco dye having a melting point of at least 200° C. (hereinafter referred to as first leuco dye) may be used in conjunction with a second leuco dye having a melting point lower than 200° C. Examples of the second leuco dyes include as follows:

(1) triallymethane dyes such as 3,3-bi-(p-dimethylaminophenyl)-6-dimethylaminophthalide, 3,3-bis(p-dimethylaminophenyl)phthalide, 3-(p-dimethylaminophenyl)-3-(1,2-dimethylindole-3-yl) phthalide, 3-(p-dimethylaminophenyl)-3-(2-methylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-6-dimethylaminophthalide, 3,3-bis(2-phenylindole-3-yl)-6-dimethyliminophthalide and 3-p-dimethylaminophenyl-3-(1-methylpyrrol-3-yl)-6-dimethylaminoph thalide;

(2) diphenylmethane dyes such as 4,4'-bis-dimethylaminobenzhydrylbenzyl ether, N-halophenyl-leucoauramine and N-2,4,5-trichlorophenyl-leucoauramine;

(3) thiazine dyes such as benzoylleucomethylene blue and p-nitrobenzoylmethylene blue;

(4) spiro dyes such as 3-methyl-spiro-dinaphthopyrane, 3-ethyl-spiro-dinaphthopyrane, 3-phenyl-spiro-dinaphthopyrane, 3-benzyl-spiro-dinaphthopyrane, 3-methyl-naphtho-(6'-methoxybenzo)-spiro-pyrane and 3-propyl-spiro-dibenzopyrane;

(5) lactam dyes such as rhodamine B-anilinolactam, rhodamine(p-nitroanilino)lactam and rhodamine(o-chloroanilino)lactam; and (6) Fluoran dyes such as 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-N-acetyl-N-methylaminofluoran, 3-diethylamino-7-N-methylaminofluoran, 3-diethylamino-7-dibenzylaminofluoran, 3-diethylamino-7-N-methyl-N-benzylaminofluoran, 3-diethylamino-7-N-chloroethyl-N-methylaminofluoran, 3-diethylamino-7-N-diethylaminofluoran, 3-(N-ethyl-p-toluidino)-6-methyl-7-anilinofluoran, 3-(N-ethyl-p-toluidino)-6-methyl-7-(p-toluidino)fluoran, 3-diethylamino-6-methyl-7-anilinofluoran, 3-diethylamino-7-(2-carbomethoxyanilino)-fluoran, 3-(N-cyclohyxyl-N-methylamino)-6-methyl-7-anilinofluoran, 3-diethylamino-6-methyl-7-xylidinofluoran, 3-dibutylamino-7-(o-chloroanilino)fluoran, 3-pyrrolidino-6-methyl-7-p-butylanilinofluoran, 3-diethylamino-7-(o-fluoroanilino)-fluoran, 3-dibutylamino-7-(o-fluoroanilino) fluoran, 3-dibutylamino-6-methyl-7-anilinofluoran, 3-dipentylamino-6-methyl-7-anilinofluoran, 3-(M-methyl-N-n-amyl)amino-6-methyl-7-anilinofluoran, 3-(N-ethyl-N-n-amyl)amino-6-methyl-7-anilinofluoran, 3-(N-ethyl-N-isoamyl)amino-6-methyl-7-anilinofluoran, 3-(N-methyl-N-n-hexyl) amino-6-methyl-7-anilinofluoran, 3-(N-ethyl-N-β-ethylhexyl)amino-6-methyl-7-anilinofluoran, 3-(N-ethyl-N-tetrafydrofurfuryl)amino-6-methyl-7-anilinofluoran and 3-(N-ethyl-N-cyclopentyl)amino-6-methyl-7-anilinofluoran.

The leuco dye is generally used in an amount of 10–50% by weight, preferably 20–40 % by weight based on the weight of the thermosensitive color-developing layer for reasons of color density and storage stability.

It is also important that the color developer used in the present invention have a melting point of at least 180° C., preferably 180°–220° C. in order to obtain good lightfastness and heat resistance. Illustrative of suitable developers are as follows:

(A) 2,4'-dihydroxyphenylsulfone of the formula:

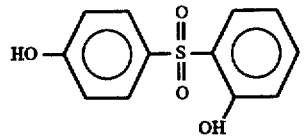

(melting point: 185° C.);

(B) 2,4,4'-trihydroxyphenylsulfone of the formula:

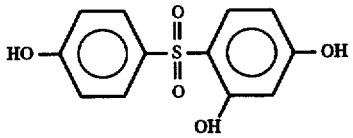

(melting point: 215° C.);

(C) 4,4'-dihydroxybenzophenone of the formula:

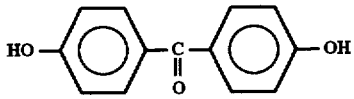

(melting point: 216° C.);

(D) bis(4-hydroxyphenyl)sulfone of the formula:

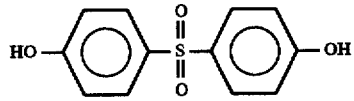

(melting point: 247° C.); and (E) 4,4'-dihydroxy-2,3'-dimethylphenylsulfone of the formula:

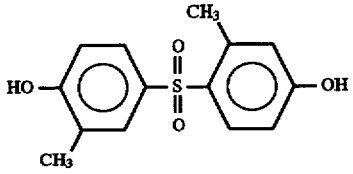

(melting point: 276° C.).

Above all, the use of 2,4'-dihydroxyphenylsulfone is particularly preferred. The above color developers may be used singly or in combination of two or more thereof.

If desired, the color developer having a melting point of at least 180° C. (hereinafter referred to as first developer) may be used in conjunction with a second developer having a melting point lower than 180° C. Examples of the second developers include as follows:

(1) phenol compounds such as 4-t-butylphenol, 4-hydroxydiphenoxide, α-naphthol, β-naphthol, 4-hydroxyacetophenol, 4-t-octylchatechol, 2,2'-dihydoxydiphenyl, 4,4'-isopropylidenebis(2-t-butylphenol), 4,4'-s-butylidenediphenol, 4-phenylphenol, 4,4'-isopropylidenediphenol, 2,2-bis(4-hydroxyphenyl)-4-methylpentane, 2,2'-methylenebis(4-chlorophenyl), hydroquinone, 4,4'-cyclohexylidenediphenol, 4,4'-dihydroxydiphenylsulfide and hydroquinone nomonenzyl ether;

(2) hydroxybenzophenone compounds such as 4-hydroxybenzophenone, 2,4-dihydroxybenzophenone, 2,4,4'-trihydroxybenzophenone and 2,2',4,4'-tetrahydroxybenzophenone;

(3) aromatic esters having a phenolic hydroxyl group such as dimethyl 4-hydroxyphthalate, methyl 4-hydroxybenzoate, propyl 4-hydroxybenzoate, sec-butyl 4-hydroxybenzoate, pentyl 4-hydroxybenzoate, phenyl 4-hydroxybenzoate, benzyl 4-hydroxybenzoate, tolyl 4-hydroxybenzoate, chlorophenyl 4-hydroxybenzoate, phenylpropyl 4-hydroxybenzoate, phenethyl 4-hydroxybenzoate, p-chlorobenzyl 4-hydroxybenzoate and p-methoxybenzyl 4-hydroxybenzoate;

(4) phenol-type copolymers such as phenol novolak resins and polyphenols;

(5) aromatic carboxylic acids such as benzoic acid, p-t-butylbenzoic acid, trichlorobenzoic acid, terephthalic acid, 3-s-butyl-4-hydroxybenzoic acid, 3-cyclohexyl-4-hydroxybenzoic acid and 3,5-dimethyl-4-hydroxybenzoid acid;

(6) 4-hydroxydiphenylsulfoae compounds such as 4,4'-dihydroxydiphenylsulfone, 4-hydroxy-4'-isopropyloxydiphenylsulfone, bis(3-allyl-4-hydroxyphenyl) sulfone, 4-hydroxy-4'-methyldiphenylsulfone, 3,4-dihydroxydiphenylsulfone and 3,4-dihydroxy-4'-methyldiphenylsulfone;

(7) sulfides such as bis(3-t-butyl-4-hydroxy-6-methylphenyl)sulfide and bis(2-methyl-4-hydroxy-6-t-butylphenyl) sulfide; and (8) organic acidic compounds such as antipyrine complex of zinc thiocyanate, and salts of the above developers (1)–(3) and (5) such as zinc, magnesium, aluminum, calcium, titanium, manganese, tin and nickel salts.

The color developer is generally used in an amount of 1–5 times, preferably 2–4 times, the weight of the leuco dye for reasons of color density and storage stability.

It is preferred that the thermosensitive color-developing layer additionally contain an image stabilizing agent which is an organic substance having a melting point of at least 200° C. for reasons of improved stability of the developed images, in particular improved resistance of the images to water and chemicals such as plasticizers. The image stabilizing agent is suitably an aromatic compound preferably having two more more benzene nuclei. Examples of suitable image stabilizing agents are as follows:

(A) bis(3,5-dibromo-4-hydroxyphenyl)sulfone of the formula:

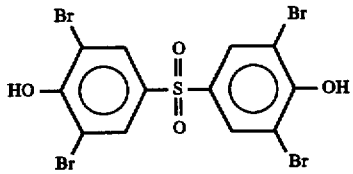

(melting point: 290° C.);

(B) bis(4-hydroxyphenyl)sulfone of the formula:

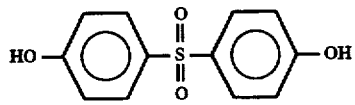

(melting point: 216° C.);

(C) 1,1,3-tris(2-methyl-4-hydroxy-5-cyclohexylphenyl) butane of the formula:

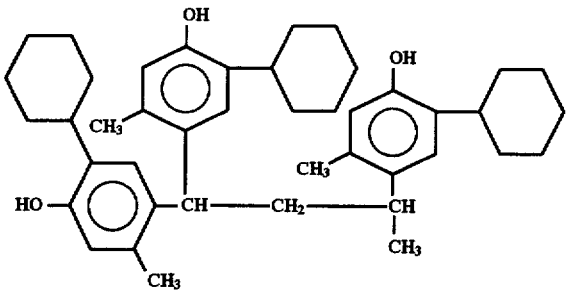

(melting point: 215° C.);

(D) dodecanedio-bis[(2-hydroxybenzoyl)hydrazide] of the formula:

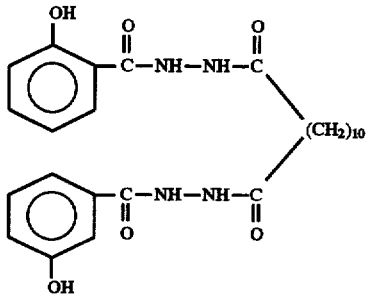

(melting point: 210° C.);

(E) sodium salt of di(2,4,6-tri-t-butylphenyl) hydrogenphosphate of the formula:

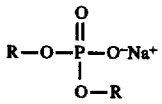

wherein R represents a 2,4,6-t-butylphenyl group (melting point: 300° C.);

(F) 3-(2-hydroxybenzoylamino)-1-H-1,2,4-triazine of the formula:

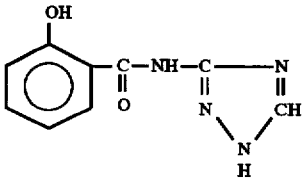

(melting point: 300° C.);

(G) 1,3,5-tris(4-hydroxy-3,5-di-t-butylbenzyl)isocyanuric acid of the formula:

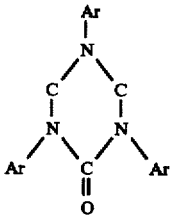

wherein Ar represents a 4-hydroxy-3,5-di-t-butylbenzyl group (melting point: 221° C.); and (H) 1,1-bis(2-methyl-4-hydroxy-5-t-butylphenyl)butane of the formula:

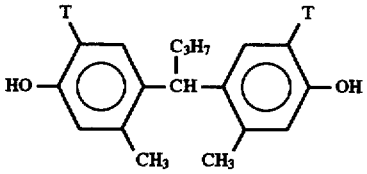

wherein T represents a t-butyl group (melting point: 209° C.).

Above all, the use of the image developing agent (A)–(D) is particularly preferred.

The image developing agent is generally used in an amount of 0.5–5 times, preferably 1–3 times/the weight of the leuco dye.

The thermosensitive color-developing layer may contain a binder to firmly bond the layer to the support. Any binder conventionally used in the field of the thermosensitive recording medium may be employed for the purpose of the present invention. Illustrative of suitable binders are starch, hydroxyethyl cellulose, methyl cellulose, carboxymethyl cellulose, gelatin, casein, gum Arabic, polyvinyl alcohol, a salt of a styrene-maleic anhydride copolymer, a salt of a styrene-acrylic acid copolymer and an emulsion of a styrene-butadiene copolymer.

Various additives may be further incorporated into the color-developing layer. The additive include a dispersing agent such as sodium dioctylsulfosuccinate, sodium dodecylbenzenesulfonate, sodium laurylalcohol sulfate or a metal salt of a fatty acid; a UV absorbing agent such as triazole; an antifoaming agent; a fluorescent dye; a pigment; a lubricant for preventing the sticking of the recording medium to a thermal head, such as a stearate wax, polyethylene wax, carnauba wax, microcrystalline wax, carboxyl-modified paraffin wax, zinc stearate or calcium stearate; and an inorganic or organic filler for preventing the deposition of dirt onto a thermal head, such as kaolin, clay, talc, calcium carbonate, magnesium carbonate, calcined clay, titanium oxide, diatomaceous earth, anhydrous silica, activated clay, styrene microball, nylon powder, polyethylene powder or urea-formaldehyde resin.

The thermosensitive color-developing layer may be formed on the support by applying a coating of a composition containing the above ingredients. For example, the above ingredients are homogeneously dispersed in a suitable dispersing medium such as water and the resulting dispersion is coated by a wire bar to a predetermined thickness over the support, followed by drying of the coat. The color-developing layer generally has a thickness of 2–10 μm, preferably 4–8 μm.

Preferably, a heat insulating layer is provided between the support and the color developing layer. By this expedient, thermal energy applied to the medium for recording can be efficiently utilized so that an image having a high image density is obtainable even with a limited thermal energy. Further, when a heat is applied from the backside of the support, the coloring of the color-developing layer can be prevented by the provision of the heat insulating layer. Thus, the heat resistance of the thermosensitive recording medium can be improved.

The insulating layer contains a filler in the form of empty beads having an outside diameter $D_o$ of 0.1–10 μm, preferably 1–5 μm, and an inside diameter $D_i$ which is at least 30%, preferably 50–95%, of the outside diameter ($D_i \geqq 0.3\ D_o$, preferably $0.95\ D_o \geqq D_i \geqq 0.5\ D_o$). The thickness of the heat insulating layer is generally 1–10 μm, preferably 3–5 μm. The empty beads filler is generally used in an amount of at least 30%, preferably 50–80%, of the volume of the heat insulating layer.

Both organic and inorganic empty beads may be used for the purpose of the present invention. Illustrative of suitable inorganic beads are glass empty beads and ceramic empty beads. Illustrative of suitable organic beads are empty beads formed of a polymer such as an acrylic polymer or a polyvinylidene chloride polymer. The empty beads are commercially available as OP-90 and OP-62 (products of Rohm & Haas Inc.) and MICROSPHERES (product of Sakemoro Yushi Co., Ltd.). A binder such as an emulsion resin or a water-soluble resin may be used for supporting the beads in the heat insulating layer and for bonding the layer to the adjacent layer and the support. The heat insulating layer may be formed in the same manner as that for the thermosensitive color-developing layer.

If desired, various other additional layers may be provided in the thermosensitive recording medium. For example, an overcoat layer may be provided over the surface of the thermosensitive color-developing layer for protecting same. A protecting layer may also be provided on the backside surface of the support to protect the recording medium during the recording operation. An adhesive layer may be interposed between the support and the color-developing layer for improving the adhesion therebetween.

The thermosensitive recording medium thus constructed may be heated imagewise with a thermal head to give color-developed image.

The following examples will further illustrate present invention. Parts and percentages are by weight.

EXAMPLES 1–10 AND COMPARATIVE EXAMPLES 1–17

Preparation of Dispersion A:

The following components were ground with a sand mill for about 10 hours into an average particle diameter of 1–2 μm to obtain Dispersion A.

Leuco dye 10 parts

5% Aqueous methyl cellulose solution 20 parts

Water 70 parts

Preparation of Dispersion B:

The following components were ground with a sand mill for about 10 hours into an average particle diameter of 1–2 μm to obtain Dispersion B.

Developer 10 parts

5% Aqueous methyl cellulose solution 20 parts

Water 70 parts

Preparation of Coating Liquid I:

The following components were mixed to obtain Coating Liquid I.

Dispersion A 10 parts

Dispersion B 30 parts

10% Zinc stearate dispersion I part

10% Kaolin dispersion 20 parts

Water 39 parts

Preparation of coating Liquid II:

The following components were mixed to obtain Coating Liquid II.

30% Empty beads dispersion* 50 parts

30% Styrene-butadiene latex emulsion 50 parts

*:beads made of a styrene-acrylic resin (outer diameter: 1.0 μm, inside diameter: 0.5 μm)

Preparation of Thermosensitive Recording Media:

Coating Liquid I obtained above was coated over the surface of high quality paper and dried to form a thermosensitive color-developing layer having a dried weight of 5 g/m$^2$. The kinds of the leuco dye and developer were varied as shown in Table 1, thereby obtaining thermosensitive recording media of Examples 1–10 and Comparative Examples 1–17. In the case of the recording media of Example 10 and Comparative Example 17, Coating liquid II was coated and dried to form a heat insulating layer having a dried weight of 3 g/m$^2$ before the formation of the thermosensitive color-developing layer. In Table 1, leuco dyes (A), (B) and (C) and developers (A), (C) and (D) are as shown previously.

TABLE 1

Combination of Leuco Dye and Developer

| Example No. | Lueco Dye | Developer |
|---|---|---|
| 1 | (C) | (D) |
| 2 | (C) | (C) |
| 3 | (C) | (A) |
| 4 | (B) | (D) |
| 5 | (B) | (C) |
| 6 | (B) | (A) |
| 7 | (A) | (D) |
| 8 | (A) | (C) |
| 9 | (A) | (A) |
| 10 | (A) | (A) |
| Comp. Ex. 1 | (C) | (*3) |
| Comp. Ex. 2 | (C) | (*4) |
| Comp. Ex. 3 | (B) | (*3) |
| Comp. Ex. 4 | (B) | (*4) |
| Comp. Ex. 5 | (A) | (*3) |
| Comp. Ex. 6 | (A) | (*4) |
| Comp. Ex. 7 | (*1) | (D) |
| Comp. Ex. 8 | (*1) | (C) |
| Comp. Ex. 9 | (*1) | (A) |
| Comp. Ex. 10 | (*1) | (*3) |
| Comp. Ex. 11 | (*1) | (*4) |
| Comp. Ex. 12 | (*2) | (D) |
| Comp. Ex. 13 | (*2) | (C) |
| Comp. Ex. 14 | (*2) | (A) |
| Comp. Ex. 15 | (*2) | (*3) |
| Comp. Ex. 16 | (*2) | (*4) |
| Comp. Ex. 17 | (C) | (*3) |

*1: 3-diamylamino-6-methyl-7-anilinofluoran (melting point: 182° C.) having the following formula:

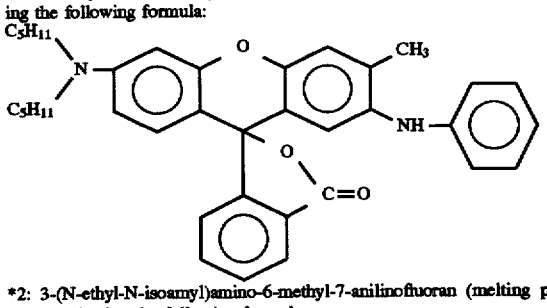

*2: 3-(N-ethyl-N-isoamyl)amino-6-methyl-7-anilinofluoran (melting point: 165° C.) having the following formula:

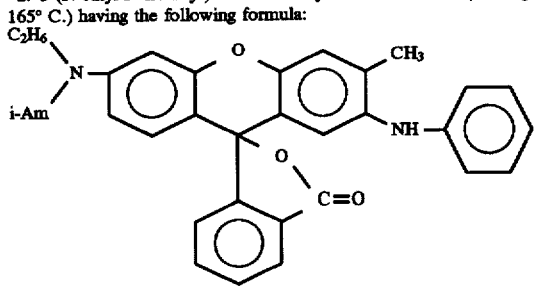

TABLE 1-continued

| Combination of Leuco Dye and Developer | | |
|---|---|---|
| Example No. | Lueco Dye | Developer |

wherein i-Am represents an isoamyl group

*3: bis(2-methyl-4-hydroxy-5-t-butyl)thioether (melting point: 159° C.) having the following formula:

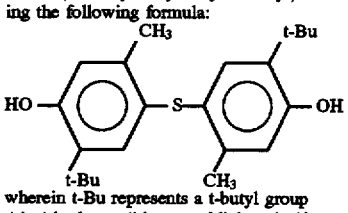

wherein t-Bu represents a t-butyl group

*4: 4-hydroxy-4'-isopropyldiphenylsulfone (melting point: 127° C.) having the following formula:

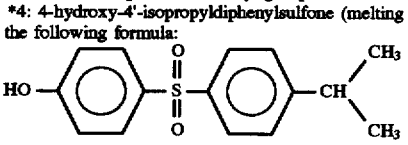

The thermosensitive recording media thus obtained were tested for their thermal sensitivity, heat resistance, lightfastness and backside heat resistance to obtain the results shown in Table 2 below. The test methods are as follows.

Thermal Sensitivity:

Using a simulator (manufactured by Matsushita Electronic Components Co., Ltd.), a sample recording medium is applied with an electric energy of 0.65 W per 1.2 msec. The density of the image thus developed is measured by McBeth Densitometer RD-914.

Heat Resistance:

A sample recording medium which has been subjected to a recording process in the same manner as in the thermal sensitivity test is allowed to stand at 100° C. for 24 hours. Thereafter, the color densities of the background (BG) and the image (IM) are measured by McBeth Densitometer RD-914.

Lightfastness:

A sample recording medium which has been subjected to a recording process in the same manner as in the thermal sensitivity test is irradiated with light of 0.35 W/m$^2$ from a xenon lamp for 24 hours. Thereafter, the color densities of the background (BG) and the image (IM) are measured by McBeth Densitometer RD-914.

Backside Thermal Resistance:

The backside of a sample recording medium is contacted with a hot plate at 250° C. for 2 seconds. Thereafter, the color densities of the thermosensitive color-developing layer is measured by McBeth Densitometer RD-914.

From the results shown in Table 2, it will be appreciated that the thermosensitive recording media according to the present invention exhibit higher thermal sensitivity and better resistance to heat and light as compared with comparative samples. With regard to the lightfastness, it should be noted that the difference in color density between the image portion and the background is in the range of 0.8–1.2 in the case of the present invention, whereas the difference is 0.49–0.84 in the case of the comparative samples. This fact indicates that, with the present invention, recorded image has a good contrast even after exposure to light.

TABLE 2

| Example | Sensi- | Heat Resistance | | Lightfastness | | Backside Heat Re- |
|---|---|---|---|---|---|---|
| No. | tivity | BG | IM | BG | IM | sistance |
| 1 | 1.19 | 0.12 | 1.15 | 0.13 | 1.00 | 0.20 |
| 2 | 1.20 | 0.13 | 1.16 | 0.13 | 1.03 | 0.18 |
| 3 | 1.20 | 0.14 | 1.18 | 0.13 | 1.02 | 0.19 |
| 4 | 1.20 | 0.14 | 1.18 | 0.13 | 1.00 | 0.18 |
| 5 | 1.21 | 0.13 | 1.19 | 0.13 | 0.97 | 0.17 |
| 6 | 1.22 | 0.13 | 1.19 | 0.14 | 0.95 | 0.18 |
| 7 | 1.22 | 0.14 | 1.16 | 0.14 | 0.96 | 0.18 |
| 8 | 1.22 | 0.12 | 1.18 | 0.13 | 1.04 | 0.18 |
| 9 | 1.24 | 0.13 | 1.24 | 0.11 | 1.25 | 0.18 |
| 10 | 1.30 | 0.14 | 1.30 | 0.11 | 1.28 | 0.12 |
| Comp.1 | 1.20 | 0.35 | 0.95 | 0.18 | 0.92 | 1.10 |
| Comp.2 | 1.24 | 0.90 | 1.00 | 0.18 | 0.92 | 1.20 |
| Comp.3 | 1.22 | 0.36 | 0.92 | 0.19 | 1.02 | 1.20 |
| Comp.4 | 1.24 | 0.98 | 1.02 | 0.17 | 0.99 | 1.25 |
| Comp.5 | 1.20 | 0.40 | 0.85 | 0.15 | 1.02 | 1.28 |
| Comp.6 | 1.21 | 0.95 | 0.95 | 0.19 | 0.89 | 1.27 |
| Comp.7 | 1.20 | 0.75 | 0.85 | 0.22 | 0.92 | 1.28 |
| Comp.8 | 1.22 | 0.85 | 1.02 | 0.22 | 0.98 | 1.29 |
| Comp.9 | 1.24 | 0.79 | 0.88 | 0.23 | 1.01 | 1.30 |
| Comp.10 | 1.24 | 0.98 | 1.12 | 0.24 | 1.02 | 1.30 |
| Comp.11 | 1.26 | 1.05 | 1.05 | 0.25 | 0.98 | 1.30 |
| Comp.12 | 1.24 | 1.21 | 1.21 | 0.18 | 0.72 | 1.30 |
| Comp.13 | 1.26 | 1.20 | 1.20 | 0.18 | 0.75 | 1.29 |
| Comp.14 | 1.26 | 1.20 | 1.20 | 0.19 | 0.68 | 1.30 |
| Comp.15 | 1.30 | 1.20 | 1.20 | 0.18 | 0.69 | 1.29 |
| Comp.16 | 1.30 | 1.19 | 1.18 | 0.20 | 0.72 | 1.30 |
| Comp.17 | 1.30 | 1.20 | 1.20 | 0.19 | 0.73 | 1.30 |

EXAMPLES 11–19, COMPARATIVE EXAMPLES 18 AND 19 AND REFERENCE EXAMPLES 1 AND 2

Preparation of Dispersion C:

The following components were ground with a sand mill for about 10 hours into an average particle diameter of 1–2 μm to obtain Dispersion C.

Image stabilizing agent 10 parts

5% Aqueous methyl cellulose solution 20 parts

Water 70 parts

Preparation of Coating Liquid III:

The following components were mixed to obtain Coating Liquid III.

Dispersion A 10 parts

Dispersion B 30 parts

Dispersion C 20 parts

10% Zinc stearate dispersion 1 part

10% Kaolin dispersion 20 parts

Water 19 parts

Preparation of Thermosensitive Recording Media:

Using Coating Liquid III obtained above, thermosensitive recording media of Examples 11–19, Comparative Examples 18 and 19 and Reference Examples 1 and 2 were prepared in the same manner as that in Example 1. In Examples 11–19 and Reference Examples 1 and 2, the leuco dye and developer were as those used in Example 9. The leuco dye and developer used in Comparative Examples 18 and 19 were the same as those used in Comparative Examples 6 and 9, respectively. The kinds of the image stabilizing agents were varied as shown in Table 3. In the only case of the recording media of Example 19, Coating liquid II was coated and dried to form a heat insulating layer having a dried weight of 3 g/m$^2$ before the formation of the thermosensitive color-developing layer. In Table 3, the image stabilizing agents (A)–(H) are as shown previously.

TABLE 3

Combination of Leuco Dye, Developer and Image Stabilizing Agent

| Example No. | Leuco Dye and Developer | Image Stabilizing Agent | Heat Insulating Layer |
|---|---|---|---|
| 9 | Example 9 | none | none |
| 11 | Example 9 | (E) | none |
| 12 | Example 9 | (F) | none |
| 13 | Example 9 | (A) | none |
| 14 | Example 9 | (G) | none |
| 15 | Example 9 | (B) | none |
| 16 | Example 9 | (C) | none |
| 17 | Example 9 | (D) | none |
| 18 | Example 9 | (H) | none |
| 19 | Example 9 | (D) | present |
| Comp. Ex. 18 | Comp. Ex. 6 | (D) | none |
| Comp. Ex. 19 | Comp. Ex. 9 | (D) | none |
| Ref. Ex. 1 | Example 9 | (*5) | none |
| Ref. Ex. 2 | Example 9 | (*6) | none |

*5: 2,2-bis(3,5-dibromo-4-hydroxyphenyl)propane (melting point: 178° C.) having the following formula:

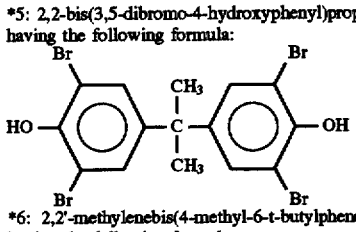

*6: 2,2'-methylenebis(4-methyl-6-t-butylphenol) (melting point: 130° C.) having the following formula:

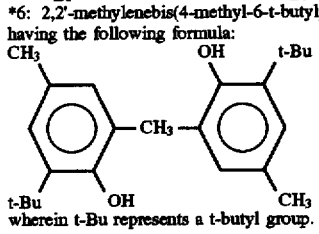

wherein t-Bu represents a t-butyl group.

The thermosensitive recording media thus obtained were tested for their thermal sensitivity, heat resistance, lightfastness, water resistance and backside heat resistance to obtain the results shown in Table 4 below.

TABLE 4

| Example No. | Sensitivity | Heat Resistance BG | Heat Resistance IM | Lightfastness BG | Lightfastness IM | Water Resistance BG | Water Resistance IM | Backside Heat Resistance |
|---|---|---|---|---|---|---|---|---|
| 9 | 1.24 | 0.13 | 1.24 | 0.11 | 1.25 | 0.11 | 1.05 | 0.18 |
| 11 | 1.24 | 0.12 | 1.18 | 0.11 | 1.22 | 0.11 | 1.20 | 0.18 |
| 12 | 1.25 | 0.11 | 1.19 | 0.11 | 1.22 | 0.11 | 1.18 | 0.17 |
| 13 | 1.24 | 0.12 | 1.20 | 0.11 | 1.24 | 0.11 | 1.19 | 0.19 |
| 14 | 1.26 | 0.11 | 1.20 | 0.11 | 1.24 | 0.11 | 1.18 | 0.16 |
| 15 | 1.23 | 0.12 | 1.22 | 0.11 | 1.24 | 0.11 | 1.19 | 0.17 |
| 16 | 1.25 | 0.12 | 1.20 | 0.11 | 1.24 | 0.11 | 1.21 | 0.18 |
| 17 | 1.25 | 0.12 | 1.19 | 0.11 | 1.24 | 0.11 | 1.22 | 0.16 |
| 18 | 1.24 | 0.12 | 1.20 | 0.11 | 1.24 | 0.11 | 1.24 | 0.17 |
| 19 | 1.30 | 0.11 | 1.20 | 0.11 | 1.28 | 0.11 | 1.26 | 0.11 |
| Comp.18 | 1.27 | 1.02 | 1.20 | 0.13 | 0.65 | 0.11 | 1.08 | 1.21 |
| Comp.19 | 1.26 | 1.02 | 1.20 | 0.13 | 1.18 | 0.11 | 1.10 | 1.24 |
| Ref. Ex.1 | 1.23 | 0.75 | 1.05 | 0.13 | 1.15 | 0.11 | 1.07 | 0.85 |
| Ref. Ex.2 | 1.25 | 0.85 | 1.09 | 0.14 | 1.16 | 0.11 | 1.06 | 0.88 |

The test method for water resistance in Table 4 is as follows:

Water Resistance:

A sample recording medium which has been subjected to a recording process in the same manner as in the thermal sensitivity test shown above is immersed in water at room temperature for 24 hours. Thereafter, the color densities of the background (BG) and the image (IM) are measured by McBeth Densitometer RD-914.

By comparing the results of Example 9 with those of Examples 11–19 shown in Table 4, it will be appreciated that the water resistance is improved by the addition of the stabilizing agents. Namely, while the image density is reduced by 0.19 through the water resistance test in the case of Example 9, the reduction is only 0–0.08 in the case of Examples 11–19. Further, the addition of the stabilizing agent does not adversely affect the other characteristics.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. A thermosensitive recording medium comprising a support, and a thermosensitive color-developing layer formed on said support and containing a leuco dye having a melting point of at least 200° C. a color developer having a melting point of at least 180° C., and an image stabilizing agent having a melting point of at least 200° C.;

wherein said image stabilizing agent is an organic compound selected from the group consisting of bis(3,5-dibromo-4-hydroxyphenyl)sulfone, bis(4-hydroxyphenyl)sulfone, dodecanedio-bis{(2-hydroxybenzoyl)hydrazide}, sodium salt of di(2,4,6-tri-t-butylphenyl)hydrogenphosphate, 3-(2-hydroxybenzoylamino)-1-H-1,2,4-triazine, 1,3,5-tris (4-hydroxy-3,5-di-t-butylbenzyl)isocyanuric acid and 1,1-bis (2-methyl-4-hydroxy-5-t-butylphenyl) butanebis(3,5-dibromo-4-hydroxyphenyl)sulfone.

2. A thermosensitive recording medium as claimed in claim 1, further comprising a heat insulating layer provided between said support and said color-developing layer and containing a filler in the form of empty beads having an outside diameter of 0.1–10 μm and an inside diameter which is at least 30% of said outside diameter.

3. A thermosensitive recording medium as claimed in claim 2, wherein said heat insulating layer contains a filler in the form of empty beads having an outside diameter of 1–5 μm and an inside diameter which is at least 30% of the outside diameter.

4. A thermosensitive recording medium as claimed in claim 1, wherein said leuco dye is 3-(N-ethyl-p-toluidino)-6-methyl-7-anilinofluoran and said color developer is 2,4'-dihydroxyphenylsulfone.

5. A thermosensitive recording medium as claimed in claim 1, wherein said leuco dye is 3-diethylamino-6-methyl-7-o-chloroanilinofluoran or 3-piperidino-6-methyl-7-anilinofluoran.

6. A thermosensitive recording medium as claimed in claim 1, wherein said thermosensitive color-developing layer further comprises a second leuco dye having a melting point lower than 200° C. selected from the group consisting of triallylmethane dyes, diphenylmethane dyes, thiazine dyes, spiro dyes, lactam dyes, fluoran dyes, and mixtures thereof.

7. The thermosensitive recording medium as claimed in claim 1, wherein said thermosensitive color-developing layer further comprises a second color developer having a melting point lower than 180° C. selected from the group consisting of phenol compounds, hydroxylbenzophenone compounds, aromatic esters having a phenolic hydroxyl group, phenol novolak resins, polyphenols, aromatic carboxylic acids, 4-hydroxydiphenyl sulfone compounds, sulfides, organic acidic compounds, salts of phenol compounds, salts of hydroxybenzophenone compounds, salts of aromatic esters having a phenolic hydroxyl group, and mixtures thereof.

* * * * *

UNITED STATES PATENT AND TRADEMARK OFFICE

CERTIFICATE OF CORRECTION

PATENT NO. : 5,703,006

DATED : December 30, 1997

INVENTOR(S) : Yasutomo MORI et al.

It is certified that error appears in the above-identified patent and that said Letters Patent is hereby corrected as shown below:

Column 3, line 53, "3,3-bi-(p-" should read --3,3-bis(p- --.

Column 6, line 46, "bis(3,5-dibromo-4-hydroxyphenyI)sulfone" should read --bis(3,5-dibromo-4-hydroxyphenyl)sulfone--.

Column 8, line 16, "1-3 times/the" should read --1-3 times, the--.

Column 9, line 12, "(product of Sakemoro" should read --(product of Sakamoto--.

Column 9, line 57, "10% Zinc stearate dispersion I part" should read --10% Zinc stearate dispersion 1 part--.

Column 12, Table 2, 5th column, "0.15" should read --0.18--.

Signed and Sealed this

Fifteenth Day of September, 1998

Bruce Lehman

*Attest:*

BRUCE LEHMAN

*Attesting Officer*

*Commissioner of Patents and Trademarks*